US011231244B1

(12) United States Patent
Sturdevant

(10) Patent No.: US 11,231,244 B1
(45) Date of Patent: Jan. 25, 2022

(54) SEMIAUTOMATIC SLIDE PIN REMOVAL TOOL

(71) Applicant: John Sturdevant, Lancaster, PA (US)

(72) Inventor: John Sturdevant, Lancaster, PA (US)

( * ) Notice: Subject to any disclaimer, the term of this patent is extended or adjusted under 35 U.S.C. 154(b) by 0 days.

(21) Appl. No.: 16/743,890

(22) Filed: Jan. 15, 2020

(51) Int. Cl.
*F41A 11/00* (2006.01)
*F41A 3/66* (2006.01)
*F41A 35/00* (2006.01)

(52) U.S. Cl.
CPC ..... *F41A 11/00* (2013.01); *F41A 3/66* (2013.01); *F41A 35/00* (2013.01)

(58) Field of Classification Search
CPC .. F41A 11/00; F41A 3/66; F41A 35/00; F41C 3/00
See application file for complete search history.

(56) References Cited

U.S. PATENT DOCUMENTS 139,633 A * 6/1873 Turner ..... F41A 29/02 15/104.19
799,125 A * 9/1905 Whinery ..... F41A 35/02 42/96
1,499,460 A * 7/1924 Kennedy ..... F41A 29/02 15/104.05
1,522,837 A * 1/1925 Rebar ..... F41A 29/02 15/104.16
1,526,177 A * 2/1925 Olberding ..... F41A 29/02 15/104.16
1,738,601 A * 12/1929 Metzger ..... F41A 29/02 15/104.19
2,409,916 A * 10/1946 Varcoe ..... F41A 29/02 15/104.165
2,616,109 A * 11/1952 Gardner ..... F41A 29/02 15/104.165
2,774,090 A * 12/1956 Neil ..... F41A 29/02 15/104.165
2,798,238 A * 7/1957 Rogovin ..... F41A 29/02 15/104.16
3,208,302 A * 9/1965 Lewis ..... F41A 29/02 74/548
3,536,160 A * 10/1970 Brewer ..... F41A 29/04 184/109
3,609,790 A * 10/1971 Butch ..... F41A 29/02 15/104.165
4,327,515 A * 5/1982 Kuryn ..... F41C 9/085 42/90

(Continued)

*Primary Examiner* — Michelle Clement
(74) *Attorney, Agent, or Firm* — John Rizvi; John Rizvi, P.A.—The Patent Professor®

(57) ABSTRACT

A semiautomatic slide pin removal tool that includes a handle member, and a tube extending perpendicular to, and outwards from, the handle member and having a distal end including a variety of different pin receivers for pushing and removing slide stop lever pins of a slide assembly on semiautomatic pistols. The pin receivers effectively and efficiently engage and mate with heads of slide stop lever pins to prevent the distal end of the slide pin removal tool from slipping or sliding off the heads of the slide stop lever pins during use. In practice, users firmly grasp an automatic pistol in one hand while negotiating the slide pin removal tool with fingers to push and remove slide stop lever pins from semiautomatic pistols with ease while freeing use of the other hand.

14 Claims, 7 Drawing Sheets

(56) References Cited

U.S. PATENT DOCUMENTS 4,407,086 A * 10/1983 Hasselmann ..... F41A 15/22 42/90
4,414,770 A * 11/1983 Brinton, Sr. ..... F42B 33/14 42/90
4,536,983 A * 8/1985 Fry ..... F41C 9/085 42/90
4,571,873 A * 2/1986 Houk ..... G01F 11/00 222/158
4,813,169 A * 3/1989 Calliebe ..... F41C 9/085 42/90
4,837,963 A * 6/1989 Slappey, Jr. ..... B25B 27/02 42/90
4,890,406 A * 1/1990 French ..... F41C 9/085 42/90
5,016,380 A * 5/1991 Jones ..... B25F 1/02 42/90
5,097,615 A * 3/1992 Kearns ..... F41C 9/085 42/90
5,127,179 A * 7/1992 Marsh ..... F41C 9/085 42/90
5,182,412 A * 1/1993 Mazza ..... F41C 9/085 42/90
5,233,124 A * 8/1993 Peterson ..... F42B 35/02 33/506
5,404,666 A * 4/1995 Cline, Jr. ..... F41A 29/02 42/90
5,416,940 A * 5/1995 Bandera ..... B25F 1/04 42/90
5,417,004 A * 5/1995 Krantz ..... F41C 9/085 42/90
5,775,021 A * 7/1998 Weiss ..... F41A 29/02 42/95
5,782,031 A * 7/1998 Bourgeois ..... F41C 27/00 42/90
5,836,099 A * 11/1998 Pace ..... F41A 29/02 42/95
5,934,000 A * 8/1999 Hayes, Sr. ..... F41A 29/02 15/104.2
6,145,235 A * 11/2000 Emerson ..... F41A 15/22 42/51
6,230,430 B1 * 5/2001 Gosselin ..... F41C 27/00 42/90
6,378,236 B1 * 4/2002 Solberg ..... F41A 29/02 15/104.165
6,904,634 B2 * 6/2005 Smith ..... B25F 1/003 7/128
7,140,141 B2 11/2006 Vaid
D555,455 S * 11/2007 Cheng ..... D8/105
7,392,611 B2 7/2008 Curry
7,637,049 B1 * 12/2009 Samson ..... F41A 35/00 42/107
8,069,606 B1 * 12/2011 Saur ..... F41A 19/33 42/108
8,091,266 B2 * 1/2012 Huang ..... F41A 29/00 42/108
8,312,664 B2 11/2012 Wray
8,371,058 B2 2/2013 Trpcic
8,640,375 B2 2/2014 Ketchum
8,850,738 B2 * 10/2014 Silver ..... F41C 27/00 42/108
8,925,235 B2 * 1/2015 Buie, II ..... F41A 29/02 42/95
8,950,100 B2 2/2015 Nebeker et al.
9,151,555 B1 * 10/2015 Huang ..... F16B 15/02
9,328,983 B2 5/2016 Wilkinson
9,448,027 B1 * 9/2016 Zinsner ..... F41A 21/482
10,054,381 B1 8/2018 Heizer et al.
10,126,078 B1 11/2018 Harris et al.
10,190,845 B1 1/2019 Olson
10,434,631 B2 * 10/2019 Johnson ..... B25B 23/0035
2005/0229467 A1 * 10/2005 Sohn ..... F41A 29/02 42/95
2008/0190006 A1 * 8/2008 Jenkins ..... B25B 27/04 42/90
2009/0151214 A1 6/2009 Williams
2009/0199345 A1 * 8/2009 Morgan ..... F41A 29/02 7/118
2010/0281747 A1 * 11/2010 Anderson ..... F41J 13/00 42/90
2010/0325933 A1 * 12/2010 Huang ..... F41A 35/00 42/90
2011/0056110 A1 * 3/2011 Henely, II ..... F41A 13/04 42/90
2011/0209378 A1 * 9/2011 Johnston ..... F41C 9/085 42/90
2011/0314719 A1 * 12/2011 Tripp ..... F41C 27/00 42/108
2013/0047483 A1 * 2/2013 Horne ..... F41C 27/00 42/90
2013/0061507 A1 * 3/2013 Hunsaker ..... F41A 29/02 42/90
2014/0290112 A1 * 10/2014 Horne ..... F41C 27/00 42/90
2016/0008968 A1 * 1/2016 Neubauer ..... B25B 15/02 7/138
2016/0109198 A1 * 4/2016 Gardner ..... F41A 3/66 411/500
2016/0223288 A1 * 8/2016 Sain ..... F41A 29/02
2016/0282072 A1 * 9/2016 Adamietz ..... F41C 27/00
2017/0043469 A1 * 2/2017 Keng ..... F41A 35/00
2019/0072123 A1 * 3/2019 Adams ..... F41A 11/00
2020/0064097 A1 * 2/2020 Millar ..... F41A 11/00

* cited by examiner

SEMIAUTOMATIC SLIDE PIN REMOVAL TOOL

FIELD OF THE INVENTION

The present invention relates to firearm accessories and tools, and more particularly, to a semiautomatic slide pin removal tool for pushing and removing a slide stop lever pins out from a lever pinhole provided on semiautomatic pistols for disassembling a slide assembly to facilitate cleaning and maintenance of the semiautomatic pistols.

BACKGROUND OF THE INVENTION

Semiautomatic pistols are small compact weapons that are generally fabricated from a number of parts or assemblies that operate together to fire projectiles in rapid succession. Such semiautomatic pistols are often used for recreational shooting, personal safety, or for military purposes. Multiple parts including a slide assembly are assembled together and function to automatically load ammunition from a magazine, generate repetitive shooting, and eject bullet casings in one fluid, contiguous operation. The slide assembly typically includes a slide, and a slide stop, sometimes referred to as a stop release. The slide stop often comprises a lever that pivots via, a lever pin inserted within a designated lever pin hole provided on one side of many semiautomatic pistols. The lever pin is perpendicular to the body of the lever, and securely inserted within the lever pin hole spanning the width of the pistol. The slide includes an elongate carriage that generally extends along the top portion of a pistol and reciprocates during the operating cycle of the pistol. The slide generally houses the firing pin and extractor, and serves as a bolt carrier group. When a last round of ammunition has been fired, a pusher operates the slide stop forcing the lever to rotate about the lever pin to engage a notch provided in the slide to retain the slide in a locked, backed position, indicating to users that the last round of ammunition has been fired. Upon mounting a newly loaded magazine with ammunition into the magazine chamber of the pistol, users simply pivot the slide stop, or lever about the lever pin and out from the notch allowing the slide to move forward while loading a bullet from the magazine and into the firing chamber of the pistol.

Maintaining automatic pistols in good working order generally entails cleaning various parts of the pistol, or making any necessary repairs. Mechanical parts including the recoil assembly, trigger mechanism, and slide assembly must be disassembled to facilitate cleaning or maintenance. In taking apart the slide assembly, it is necessary to remove the slide stop from the pistol. In doing so, the lever pin must be removed from the lever pin hole. Because the distal end of the lever pin is generally flush with the body of the pistol, a tool is needed to push the lever pin completely out from the lever pin hole to remove the slide lock. The pin is retained firmly in the lever pinhole and requires that a lateral pushing force be applied to dislodge the pin from the lever pinhole.

Various tools, including handheld tools, have been developed to assist owners in removing slide locks from automatic pistols when disassembling parts. Conventional devices have included tools with shanks or rods that include pointed or rounded ends, or solid, flat ends. Other tools include pullers with pivoting jaws that are articulated for grasping and pulling the lever pin out from the lever pinhole. Such prior art tools provide various drawbacks that frustrate the intended purpose of removing the stop lock with ease and efficiency. For instance, most prior art tools require owners to use both hands when attempting to remove the lever pin where one hand is used to hold the automatic pistol while the other hand is used to operate the tool. Also, handheld tools having pointed, or solid planar ends that makes it difficult for users to properly engage the head of the lever pin, as the distal end or tip of such handheld tools often slides or slips off the head of the lever pin forcing individuals to continuously attempt to correctly align the tip of the handheld tool with the head of the lever pin with one hand while holding onto the pistol with the other hand thus making it cumbersome, frustrating and time consuming when removing the slide lock. Prior art does not provide a handheld tool for removing a lever pin from an automatic pistol that includes a receiver end particularly designed to center itself on the heads of lever pins while retaining position of the tool during use, and that permits users to use one hand to hold an automatic pistol while maneuvering use of the tool to remove lever pins while freeing use of the other hand. Prior art tools are deficient in providing a sturdy, abutting union between heads of slide stop lever pins, and a distal end of push tool during use resulting in an inefficient, time consuming process in removing slide stop lever pins from automatic pistols.

Accordingly, there is an established need for a solution to at least one of the aforementioned problems. There remains a need for a lever pin removal tool that includes a handle, and a tube including a distal end having a pin receiver adapted for steadily mating and engaging with heads of slide stop lever pins provided on automatic pistols, to efficiently and effectively remove such slide stop lever pins from automatic pistols. There also remains a need for a lever pin removal tool that permits removing slide stop lever pins from automatic pistols using one hand by firmly grasping onto an automatic pistol, and negotiating the pin removal tool with fingers of the same hand to easily remove slide stop lever pins while freeing use of the other hand.

SUMMARY OF THE INVENTION

The present invention is directed to a lever pin removal tool that includes a handle member including a handle, a shank attached to the handle, and a stopper disposed at one end of the shank, and a tube extending perpendicular to, and outwards from, the stopper a predetermined length. The tube includes a hollow channel extending through the central axis of the tube, and a distal end including a pin receiver for readily engaging and mating with heads of slide stop lever pins to remove the stop lever pins out from a lever pin hole associated with a slide assembly of semiautomatic pistols. The pin receiver comprises differing embodiments including an inner bore having a concave configuration, an inner bore having a beveled or tapered configuration, and a peripheral edge of the hollow channel, and surrounding planar boundary or surface.

A first embodiment of the invention provides a pin removal tool operated by users in removing stop slide lever pins from semiautomatic pistols, said pin removal tool comprising a handle member including a handle having an outer surface opposite an inner surface, a tube attached perpendicular to, and extending outwards from, the inner surface, where the tube includes an outer tube surface, a hollow channel extending along a central axis of the tube beginning at a distal end of the tube and terminating at the handle member, and wherein the distal end includes a pin receiver readily engaging a head of one of the stop slide lever pins, where the pin receiver is defined by a peripheral opening of the hollow channel, and an area formed between the peripheral opening of the hollow channel, and the outer tube surface.

In one aspect, the handle member includes a round shank having one end attached to the inner surface of the handle, a round stopper attached to another end of the round shank opposite the one end, where the diameter of the round stopper is larger than the diameter of the round shank.

In one aspect, the proximate end of the tube is attached perpendicular to, and extends outwards from, one side of the stopper. In one embodiment, the tube comprises a length of 11/16 inches, an inner diameter of 7/64 inches, and an outer diameter of 9/64 inches.

In another aspect, the area includes a planar surface surrounding the peripheral opening of the hollow channel where the area includes a concave configuration forming a rounded peripheral edge, or includes a beveled configuration.

In one aspect, a proximate end of the tube is seated within an opening formed within the stopper, and the proximate end of the tube includes threads for engaging with threads provided within the opening.

In one aspect, the handle comprises a round geometric shape, and comprises a diameter that is 1 13/32 inches. The handle includes a circumferential edge having a width of at least 1/8 inch. In one embodiment, the outer surface of the handle comprises a convex formation.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed to a lever pin removal tool that includes a handle member and a tube having a distal end including a variety of different pin receiver configurations for pushing and removing slide stop lever pins associated with slide assemblies on semiautomatic pistols. The pin receivers effectively and efficiently engage and mate with heads of slide stop lever pins to prevent the distal end of the lever pin removal tool from slipping or sliding off the head during use. In practice, users firmly grasp an automatic pistol with one hand while negotiating the lever pin removal tool with fingers of the hand to push and remove slide stop lever pins from semiautomatic pistols with ease while freeing use of the other hand.

Figure 1:
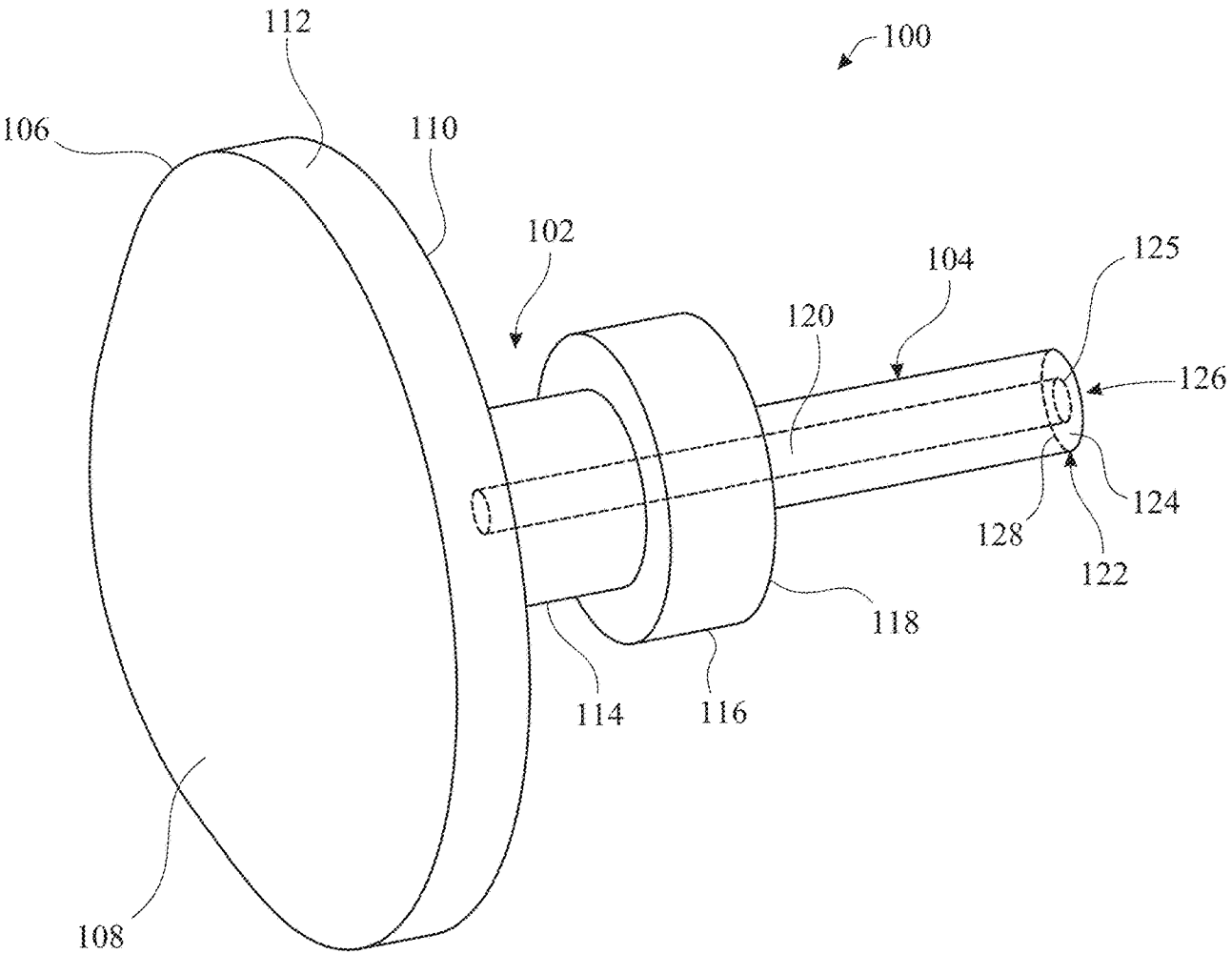
FIGS. 1 and 2 present perspective views of a pin removal tool, showing a handle member including a handle, a shank attached to the handle, and a stopper disposed at one end of the shank, and a tube including a hollow channel extending through the central axis of the tube, and a distal end including a pin receiver for engaging and mating with heads of slide stop lever pins of a slide assembly of semiautomatic pistols, in accordance with an embodiment of the present invention.
Figure 2:
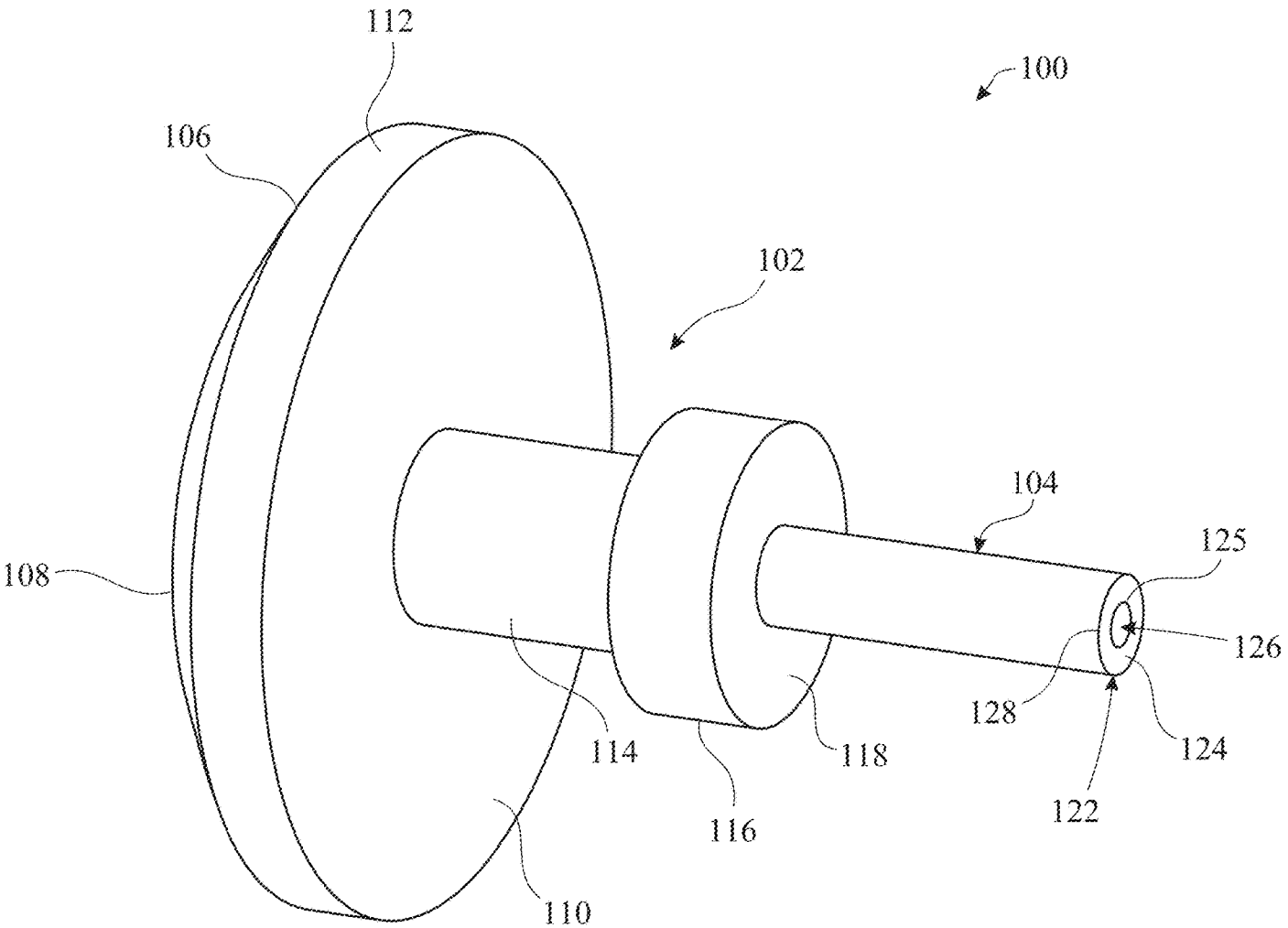

Referring now to FIGS. 1 and 2, there is presented perspective views of a slide stop lever pin removal tool 100 (hereafter referred to as a pin removal tool), for pushing and removing a slide stop lever pin 200 (hereafter referred to as a lever pin) associated with a slide assembly of an semiautomatic pistol, in accordance with one embodiment of the present invention. The pin removal tool 100 may be used with a variety of different semiautomatic pistols including, for illustrative purposes only, semiautomatic pistols such as Sig Sauer or Beretta semiautomatic pistol where the slide stop lever pin 200 includes a crown or rounded end shaped head 202.

The pin removal tool 100 comprises a handle member, generally denoted at 102, and a tube 104 having a predetermined length. The handle member 102 includes a handle 106 having an outer surface 108, and an inner surface 110, and comprises a rounded geometric shape including a diameter and a circumferential edge having a width. Handle 106 may comprise any geometric shape, design, pattern, formation, or configuration. In one embodiment, handle 106 comprises a dome-like or convex configuration, as better illustrated in FIG. 2. Handle 106 may include a friction material applied anywhere on the outer surface 108, and/or perimeter 112 of the handle 106 to prevent a user's hand and/or fingers from slipping off the handle 106 during use. Such friction material may include a rubber coating, a granule coating, ridges, indentations, protrusions, knurls, dimples, grooves or other formations.

Figure 7:
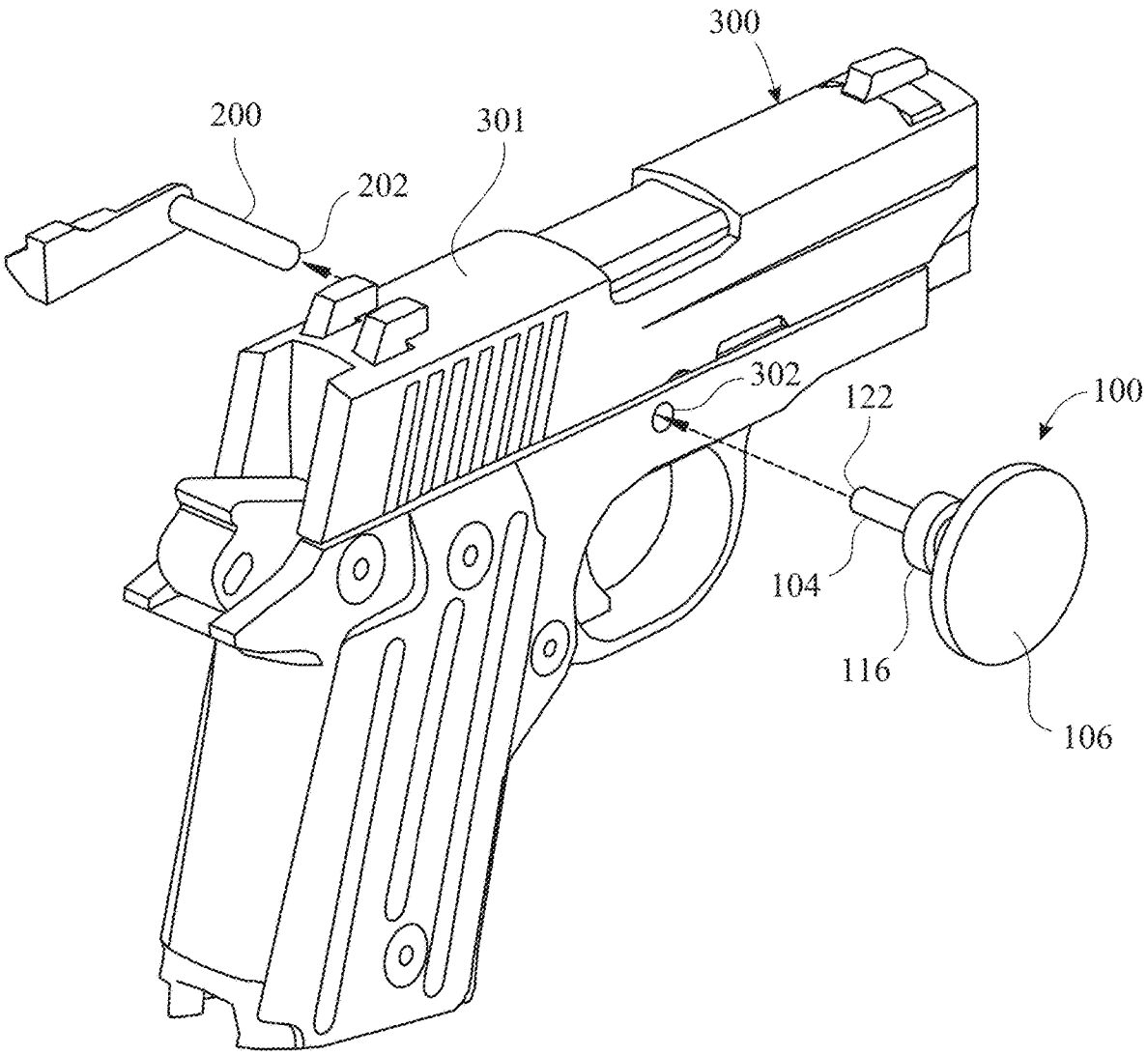
FIG. 7 presents a side, perspective view of a semiautomatic pistol, showing a distal end of the tube of the pin removal tool of FIG. 1 readily aligned with a lever pin hole accommodating entry of the slide stop lever pin, and readily inserted within a lever pin hole to effectively and efficiently push and remove the stop lever pin out from the lever pin hole of the semiautomatic pistol.

The handle member 102 includes a shank 114 extending outwards from a central region on the inner surface 110 of the handle 106 a predefined length, and a stopper 116 that is disposed at the distal end of the shank 114. The stopper 116 generally engages against the side body of a semiautomatic pistol to prevent a tube 104 from sliding further through a lever pin lever pinhole 302, which accommodates entry of a lever pin 200, as shown in FIG. 7. In one embodiment, the diametrical size of the stopper 116 is larger than that of shank 114. It is appreciated that the handle member 102 may be constructed from a durable, light or heavy weight material as one integral piece, or as separate pieces attached together using any well-known attachment means. For instance, handle member 102 may be fabricated using a mold injection, welding, casting, or other molding process or technique, and may be constructed from a durable wood, ceramic, plastic, or metal material including aluminum, stainless steel, brass, or galvanized steel to prevent or resist rust.

With continued reference to FIGS. 1 and 2, the pin removal tool 100 includes a tube 104 that extends outwards from, and perpendicular to, an outer surface 118 of stopper 116 a predetermined length. Tube 104 may be constructed from any of copper, aluminum, stainless steel, and brass, wood, ceramic or plastic. Tube 104, in one non-limiting embodiment, is integrally formed with handle member 102, or is separately attached to stopper 116 using any well-known process or technique including welding, soldering, bonding, or adhesives. In one embodiment, an opening is formed through the body of the stopper 116 to attach and receive a proximate end of the tube 104 therein. In an alternative embodiment, the opening may include threads to receive threads disposed on the proximate end of tube 104 allowing users to thread the tube 104 to the stopper 116. The threaded connection allows users to interchange tubes 104 with tubes having different pin receiver configurations to accommodate using the pin removal tool 100 with lever pins having different head configurations, shapes, formations or styles. The interchangeability allows a single handle member 102 to be used with multiple tubes if desired. Thus in one embodiment, a kit may include a handle member 102 and a plurality of interchangeable tubes each having a different pin receiver configuration. A hollow channel 120 is formed through the central axis of the body of the tube 102 beginning from a distal end 122 pf the tube 104, and terminating, in one non-limiting embodiment, at one end of the head member 102. In one embodiment, the distal end 122 includes a surrounding, planar boundary or surface 124 defined by the distance between the peripheral edge 125 of the hollow channel 120, and the outer surface 128 of tube 104 defining a pin receiver 126 for engaging and mating with the head of a lever pin 200 to effectively push and remove the lever pin 200 from a lever pin hole 302 provided on a semiautomatic pistol, as illustrated in FIG. 7. The peripheral edge 125 of the hollow channel 120, and planar boundary 124 work in unison as a pin receiver 126 to steadily engage the head 202 of a lever pin 200, as illustrated in FIG. 4.

Figure 3:
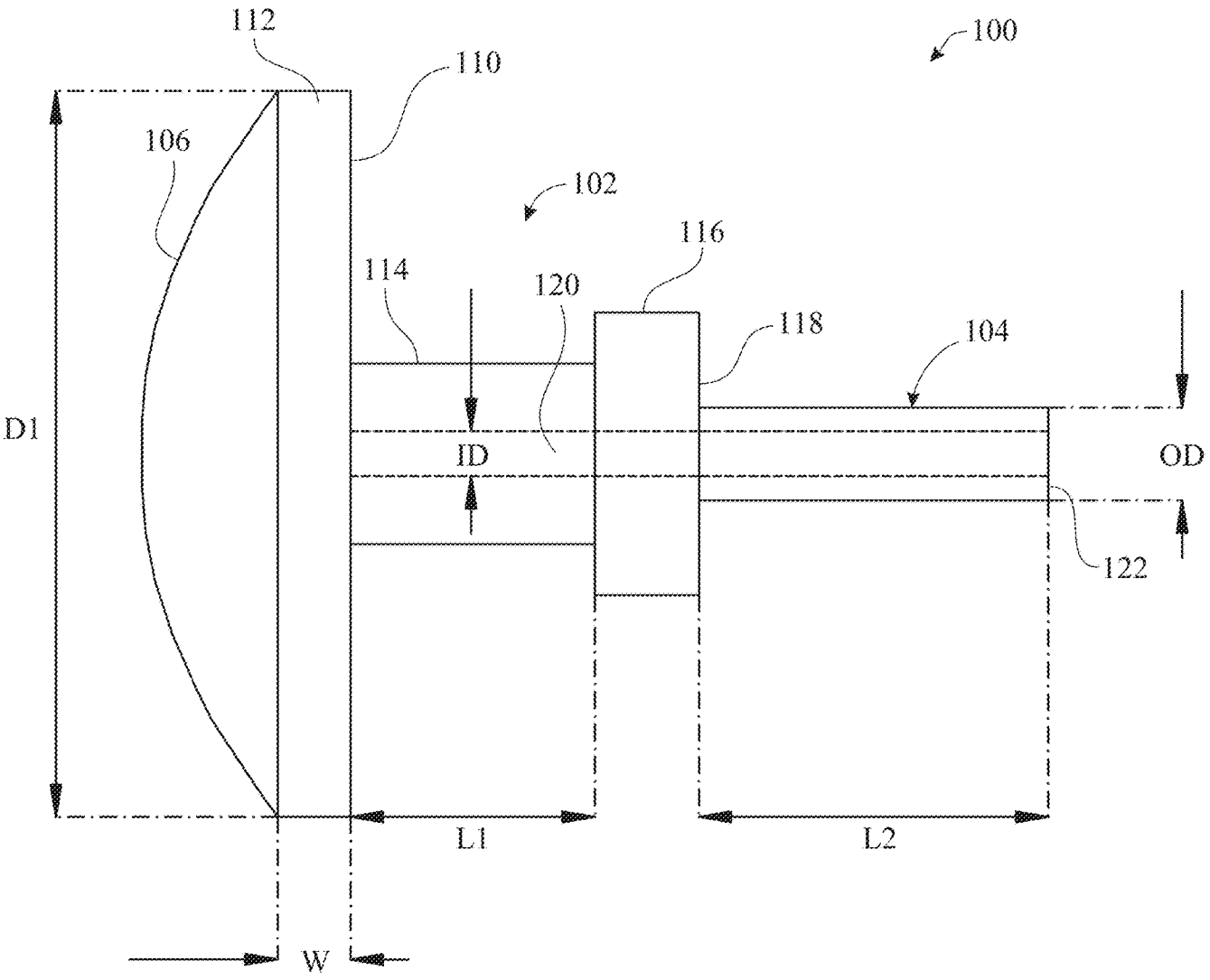
FIG. 3 presents a side view of the pin removal tool of FIGS. 1 and 2, showing dimensions of the handle member, and the tube including an outer diameter, and an inner diameter defining the hollow channel, in accordance with one embodiment of the present invention.

Turning now to FIG. 3, there is shown a side view of the pin removal tool 100 of FIGS. 1 and 2, illustrating a representative embodiment of a pin removal tool 100 having various dimensions and sizes. In the exemplary embodiment, the pin removal tool 100 comprises a handle member 102 having a head 106 including a diameter D1 having $1\frac{13}{32}$ inches and a peripheral or circumferential edge 112 having a $\frac{1}{8}$ inch width W, and a shank 114 that is $\frac{13}{32}$ inches in length L1. In one exemplary embodiment, tube 104 is $\frac{11}{16}$ inches in length L2, and includes an outer diameter OD of $\frac{9}{64}$ inches, and an inner diameter ID of $\frac{7}{64}$ inches. Various dimensions may be implemented to form the shape of stopper 116. It is understood that the dimensional sizes illustrated in FIG. 3 are merely examples of constructing a pin removal tool 100 in accordance with one embodiment and that the pin removal tool 100 may comprise any number of different dimensions, shapes, and/or sizes.

Figure 4:
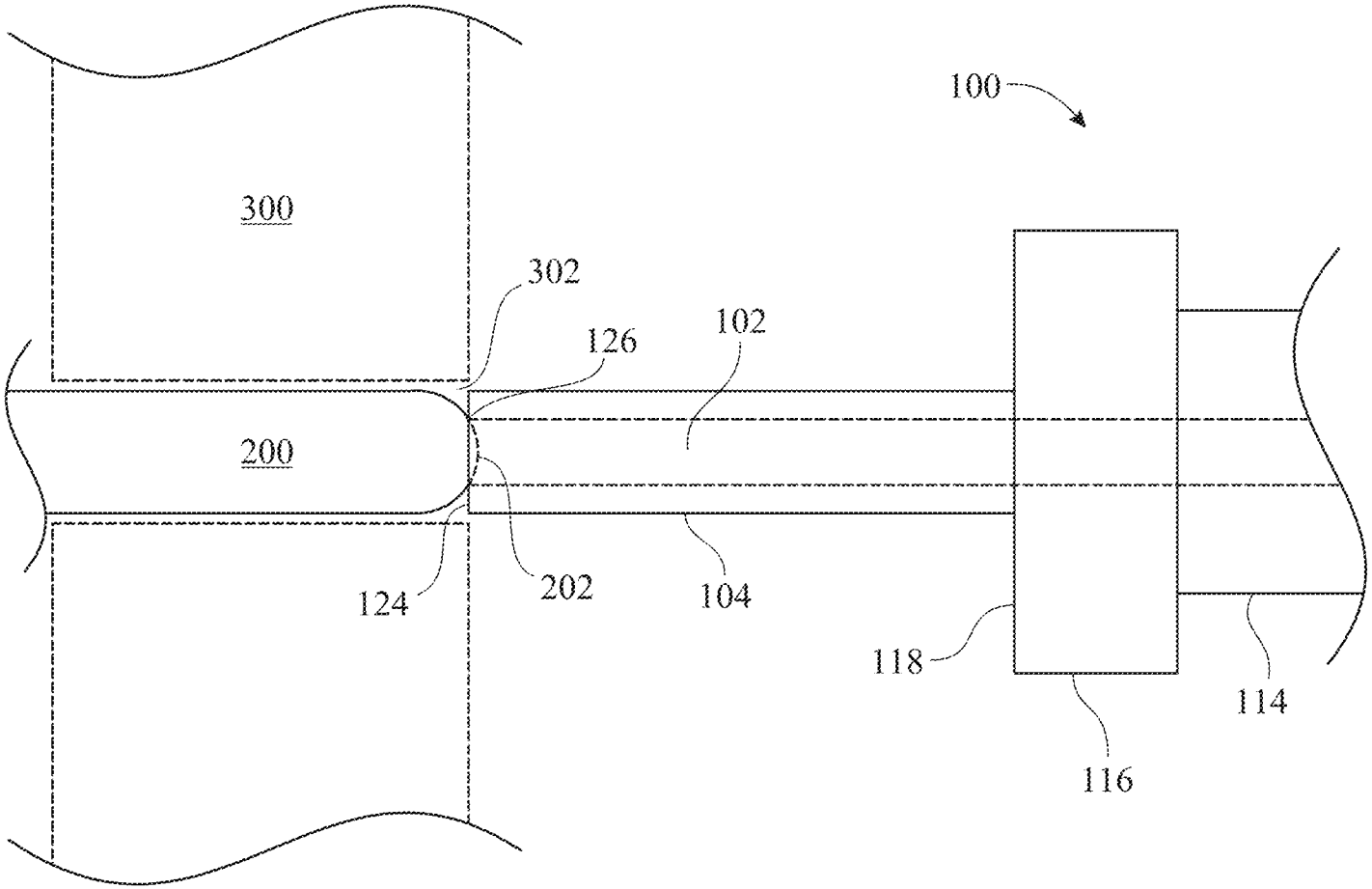
FIG. 4 presents a partial, side view of the pin removal tool, and a slide stop lever pin provided on a partial view of an semiautomatic pistol, showing the tube with a horizontal axis of the slide stop lever pin with the pin receiver engaging and mating with a head of the slide stop lever pin for readily pushing and removing the stop lever pin out from the lever pin hole of the semiautomatic pistol.

With reference made to FIG. 4, there is presented a partial, side view of a pin removal tool 100 illustrating a tube 104 centrally aligned along the same axis as a lever pin 200, with the pin receiver 126 engaging and mating with head 202 while lever pin 200 is operatively disposed in lever pin hole 302 of an semiautomatic pistol 300. The engaged or mating connection of the pin receiver 126 and head 202 provides a male to female connection that allows the distal end 122 of the tube 104 to remain attached to the head 202 without slipping, sliding, or moving off the head 202 during use. A horizontal pushing force is applied to the pin removal tool 100 to direct the tube 104 into the lever pin hole 302 of the pistol 300 pushing and removing the lever pin 200 out from the lever pin hole 302 to allow disassembly of the slide assembly of the pistol 300 for cleaning or maintenance. Semiautomatic pistols comprising a Sig Sauer or Beretta generally include a lever pin 200 having a head 202 that generally includes a head 202 having a crown configuration (having a radius). The pin receiver 126 defined by the hollow channel 120, peripheral edge 125 of the hollow channel 120, and surrounding planar boundary 124 work in unison to provide a male/female connection when steadily engaging the head 202 of lever pin 200. The seating arrangement of the head 202 within the entrance of the hollow channel 102 formed in the tube 104 provide for a sturdy, non-slipping, non-sliding engagement between the head 202 of the lever pin 200 and pin receiver 126. As shown in FIG. 4, the outer diameter OD of the tube 104 is such that the body of the tube 104 slides freely within the lever pin hole 302 provided on the semiautomatic pistol 300 to completely push the lever pin 200 out from the lever pin hole 302.

Figure 5:
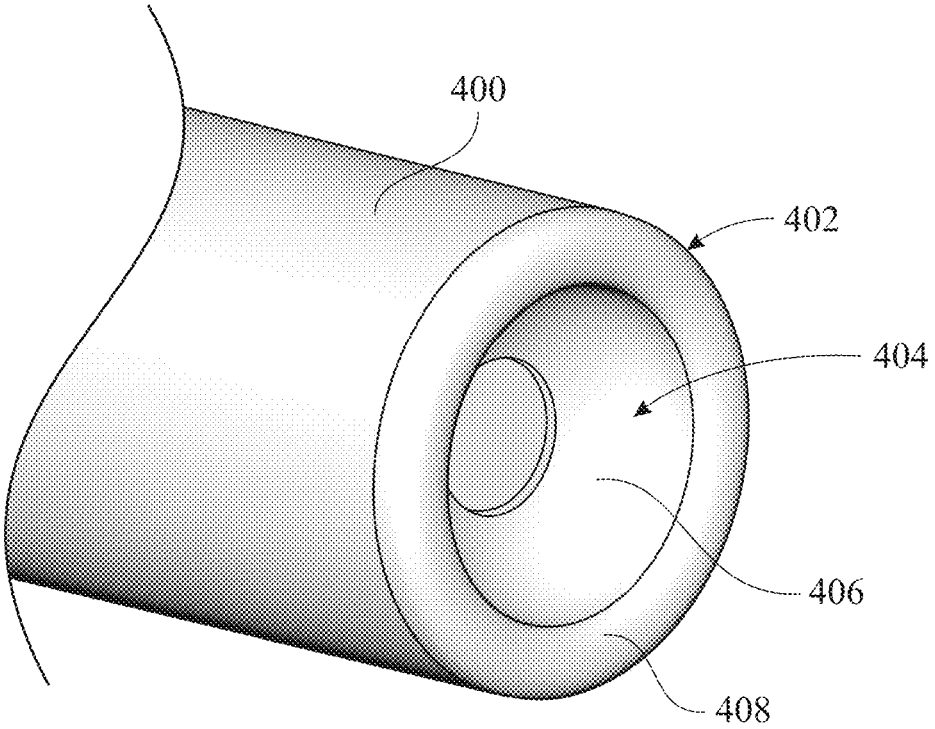
FIG. 5 presents a partial, perspective view of a tube for use on the pin removal tool, showing the tube with a distal end including a pin receiver having a concave inner bore and rounded circumference for engaging and mating with heads of slide stop lever pins.

Turning now to FIG. 5 there is shown a partial, perspective view of a tube 400 associated with a pin removal tool 100, in accordance with another embodiment. Tube 400 includes a distal end 402 having a pin receiver 404 including a concave inner bore 406 having a rounded circumference or perimeter for receiving and engaging a head 202 of a slide stop lever pin 200. Tube 400 provides a distal end 402 having a different pin receiver 404 configuration to accommodate removing lever pins having different head sizes or shapes. It is noted that the surface, or bottom surface of the inner bore 406 may be smooth, rough, and/or include a friction material or formations. The inner bore 406 is in communication with the hollow channel formed through the tube 400. In addition, pin receiver 404 may comprise any shape including a square, a rectangular, a round, an elliptical, an oval, a star, or a triangular shape or configuration. In one alternative embodiment, the inner bore 406 may include a convex formation rather than a concave formation where the convex may extend outwards from the distal end of the tube 400 a predetermined amount.

Figure 6:
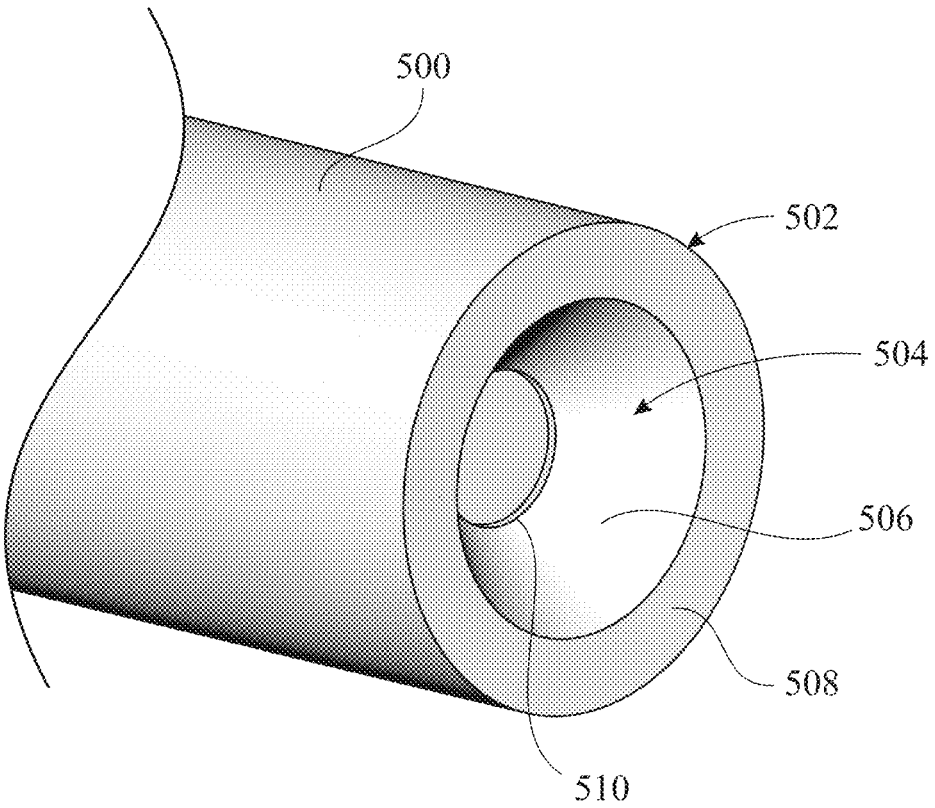
FIG. 6 presents a partial, perspective view of a tube for use on the pin removal tool, showing the tube with a distal end including a pin receiver having a beveled or tapered inner bore for engaging and mating with heads of a slide stop lever pins.

A partial, perspective view of a tube 500 associated with a pin removal tool 100, is illustrated in FIG. 6, in accordance with another embodiment of the invention. Tube 500 includes a distal end 502 having a pin receiver 504 including a beveled, or inverted cone-shaped inner bore 506 for receiving and engaging a head 202 of a slide stop lever pin 200. Tube 500 provides a distal end 502 having a different pin receiver 504 configuration for accommodating lever pins with different head sizes or shapes. Distal end 502 includes a planar boundary or surface 508 surrounding the outer perimeter of the inner bore 506. The planar boundary 508 can be used to engage the head of a slide stop lever pin 200 when used to push and remove the lever pin 200 from a lever pinhole 302 of a semiautomatic pistol 300. Pin receiver 504 is defined also by a hollow channel 510 extending through the central region of the tube 500. The surrounding wall of the inner bore 506 may be smooth, rough, and/or include a friction material or formations. It is noted that the beveled inner bore 506 may comprise any predetermined angle forming different beveled shapes.

Figure 8:
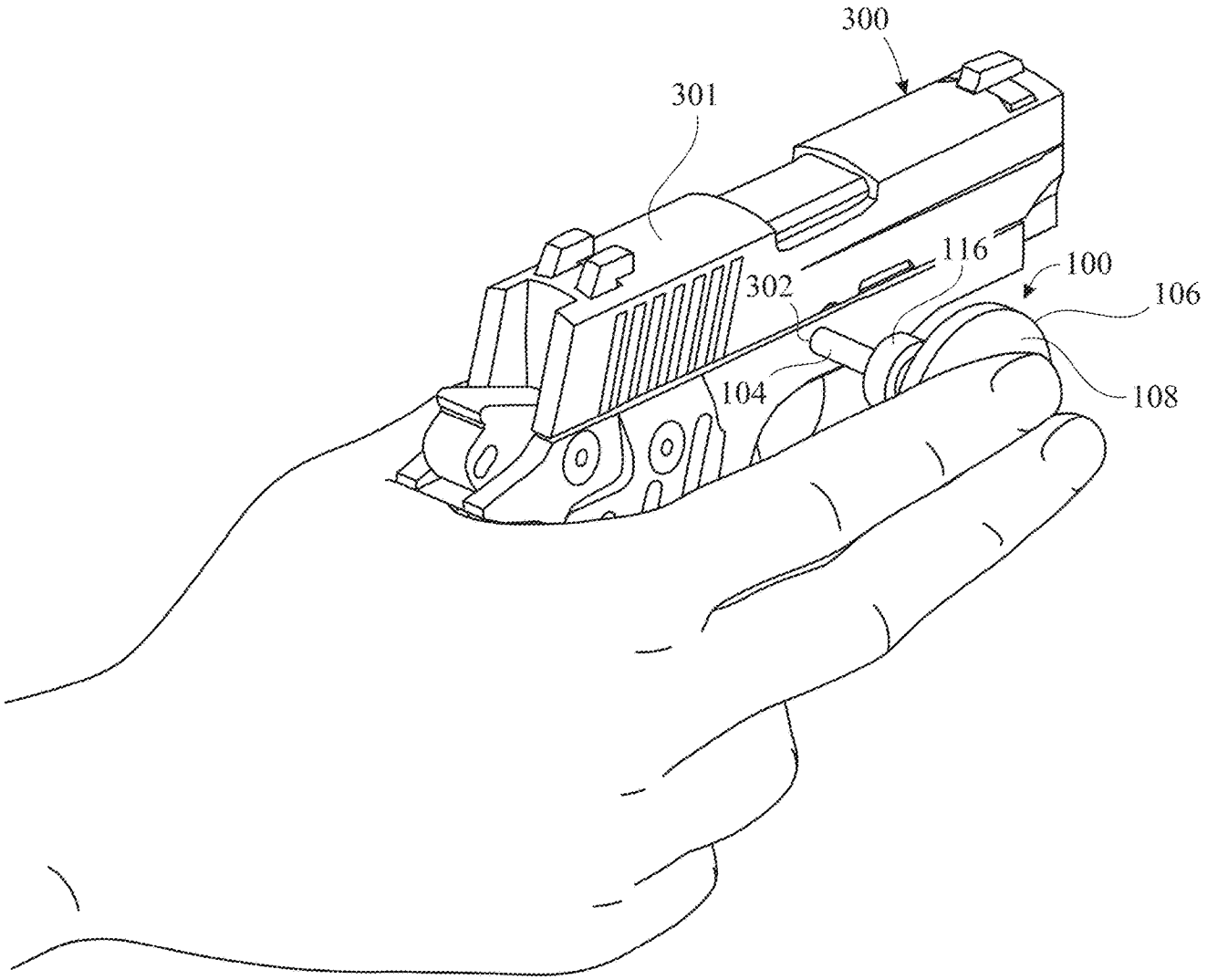
FIG. 8 presents a partial, perspective view of a user's hand holding a semiautomatic pistol while negotiating the pin removal tool with two fingers pushing the tube through the lever pinhole to engage and mate with the head of the slide stop lever pin to push and remove the pin for disassembling the slide assembly of the semiautomatic pistol.

In reference to FIG. 7 there is illustrated a side, perspective view of a semiautomatic pistol 300 including a slide assembly 301, showing a distal end 122 of a tube 104, of the pin removal tool 100 as shown in FIG. 1, readily aligned along a horizontal axis with lever pin hole 302 for retaining a slide stop lever pin 200. The tube 104 is shown readily inserted within the lever pinhole 302 to push and remove the stop lever pin 200 out from the lever pinhole 302 to disassemble the slide assembly 301 of the semiautomatic pistol 300 for cleaning or maintenance. In practice, users employ a single hand to firmly grasp onto the body of an automatic pistol 300 straddling a thumb on one side of the pistol 300, and phalange regions of fingers against the opposite side of the pistol as shown in FIG. 8. While grasping onto the semiautomatic pistol 300, users simply extend fingers outwards in a forward direction disposing the inner surfaces of the extended fingers on the outer surface 108 of the handle 106 of the pin removal tool 100. A pushing force, directed along the horizontal axis towards the pistol 300, is applied to the outer surface 108 of the handle 106 with the fingers forcing tube 104 through the lever pinhole 302 to direct the pin receiver 126 to engage and mate with head 202 of the lever pin 200. The pin receiver 126 is configured to prevent the pin receiver 125 from slipping or sliding off the head 202 of the lever pin 200 while pushing the lever pin 200 outwards from the lever pin hole 302. The practice of removing the stop lever pin 200 from the semiautomatic pistol 300 using one hand not only frees the other hand made available for other tasks, such as for example, using the free hand to move the slide 301, but allows users to remove the slide stop lever pin 200 efficiently with ease within a very short period of time such as from 3 to 15 seconds. Prior art tools provides a poor engagement connection between the distal end of the prior art tool, and head of stop slide lever pins often slipping, or sliding off during use thus requiring users to repetitively reposition and align the distal end of the prior art tool with the head of the lever pin in an effort to push the lever pin out of the hole, a process which is time consuming, frustrating, and cumbersome.

The pin removal tool 100 includes a tube 104 having a variety of different pin receivers 126, 406, 506 for steadily providing a steady, male/female connection between the distal end of the tube 104, and heads of different slide stop lever pins used in different semiautomatic pistols including, in one embodiment, a pin receiver 126 configured for removing slide stop lever pins having a crown or rounded end. The steady connection between any of the pin receivers 126, 406, 506 and the head of slide stop lever pins allow users to effectively, and efficiently remove slide stop lever pins with ease when disassembling a slide assembly of semiautomatic pistols. The constructional configuration of each pin receiver 126, 406, 506 prevents the distal end 122 of the tube 104, of the pin removal tool 100, from consistently slipping or sliding off the heads of slide stop lever pins when removing stop lever pins from semiautomatic pistols. As noted, in one embodiment, friction material or formations may be provided on the outer surface 108 of the handle 106 of the pin removal tool 100 to provide friction properties to prevent the fingers, shown in FIG. 8, from slipping, sliding, or moving off the handle 106 when negotiating the pin removal tool 100 during use. In addition, the planar surrounding boundary or surface 124 shown in FIG. 4, and 508 in FIG. 6, can be employed to help remove lever pins including a flat planar end as well. It is appreciated that a portion of the outer tube surface may be coated with a lubricous such as a coating of polytetrafluoroethylene, or PTFE to allow the end portion of the tube 104 to slide more easily through the lever pin hole 302 during use. It is appreciated that the semiautomatic pistol 300 can be rotated and held in the left hand as well, where fingers of the left hand are extended and used to negotiate the pin removal tool 100 upon removing the slide stop lever pin 200.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A slide pin removal tool operable with one or two fingers of one hand of a user holding a semi-automatic pistol to displace a slide stop lever pin disposed in a lever pin hole through a width of the semi-automatic pistol, and which engages a slide lever, thereby leaving the user's other hand free to disengage a slide of the semi-automatic pistol as needed to facilitate removal of the slide stop lever pin, wherein a head of the slide stop lever pin has a specific geometric configuration, said slide pin removal tool comprising:

a handle member comprising a handle operable by the one or two fingers of the user's one hand and a stopper attached to and spaced apart from said handle by a shank disposed between an inner surface of said handle and one side of said stopper;

a tube having a predetermined length attached to one other side of said stopper opposite said shank and extending outwardly perpendicular therefrom;

said tube comprising a cylindrical outer surface having an outer diameter which is constant along said predetermined length thereof;

said tube having a proximal end, a distal end, and a hollow channel extending at least partially therebetween;

said tube comprising a lubricious coating over at least a portion of said cylindrical outer surface to reduce friction on said portion of said cylindrical outer surface of said tube;

said distal end of said tube having a peripheral opening disposed therethrough in communication with said hollow channel, said peripheral opening at least partially defined by an inner diameter;

a pin receiver disposed on said distal end of said tube, said pin receiver at least partially defined by a boundary surface disposed between said outer surface proximate said distal end of said tube and said peripheral opening through said distal end of said tube; and said pin receiver comprising an inner bore having a predetermined configuration to maintain said pin receiver in an operative pin engaging position during operation of said slide pin removal tool.

2. The slide pin removal tool as recited in claim 1, wherein said other side of said stopper comprises an opening having a plurality of inner threads.

3. The slide pin removal tool as recited in claim 2, wherein said proximal end of said tube comprises a plurality of outer threads cooperative with said plurality of inner threads disposed in said opening in said stopper to facilitate releasably attaching said tube to said stopper.

4. The slide pin removal tool as recited in claim 3, wherein said tube is stationary relative to said stopper while releasably attached thereto.

5. The slide pin removal tool as recited in claim 1, wherein said predetermined length of said tube is about 11/16 inches and said outer diameter of said tube is about 9/64 inches.

6. The slide pin removal tool as recited in claim 1, wherein said lubricious coating comprises polytetrafluoroethylene.

7. The slide pin removal tool as recited in claim 1, wherein said tube comprises a unitary construction.

8. The slide pin removal tool as recited in claim 1, wherein said predetermined configuration of said inner bore of said pin receiver comprises a rounded configuration.

9. The slide pin removal tool as recited in claim 1, wherein said boundary surface of said pin receiver comprises a rounded configuration.

10. The slide pin removal tool as recited in claim 1, wherein said predetermined configuration of said inner bore of said pin receiver comprises a beveled configuration.

11. The slide pin removal tool as recited in claim 1, wherein said boundary surface of said pin receiver comprises a beveled configuration.

12. The slide pin removal tool as recited in claim 1, wherein said boundary surface of said pin receiver comprises a planar configuration.

13. The slide pin removal tool as recited in claim 1, wherein said inner bore of said pin receiver comprises a friction material to increase friction within said inner bore and to further facilitate maintaining said pin receiver in said operative pin engaging position during operation of said slide pin removal tool.

14. A slide pin removal tool operable with one or two fingers of one hand of a user holding a semi-automatic pistol to displace a slide stop lever pin disposed in a lever pin hole through a width of the semi-automatic pistol, and which engages a slide lever, thereby leaving the user's other hand free to disengage a slide of the semi-automatic pistol as needed to facilitate removal of the slide stop lever pin, wherein a head of the slide stop lever pin has a specific geometric configuration, said slide pin removal tool comprising:

a handle member comprising a handle operable by the one or two fingers of the user's one hand and a stopper attached to and spaced apart from said handle by a shank disposed between an inner surface of said handle and one side of said stopper;

a tube having a predetermined length attached to one other side of said stopper opposite said shank and extending outwardly perpendicular therefrom;

said tube comprising a cylindrical outer surface having an outer diameter which is constant along said predetermined length thereof;

said tube having a proximal end, a distal end, and a hollow channel extending at least partially therebetween;

said distal end of said tube having a peripheral opening disposed therethrough in communication with said hollow channel, said peripheral opening at least partially defined by an inner diameter;

a pin receiver disposed on said distal end of said tube, said pin receiver at least partially defined by a boundary surface disposed between said outer surface proximate said distal end of said tube and said peripheral opening through said distal end of said tube;

said pin receiver comprising an inner bore to maintain said pin receiver in an operative pin engaging position during operation of said slide pin removal tool; and said inner bore of said pin receiver comprises a friction material to increase friction within said inner bore and to further facilitate maintaining said pin receiver in said operative pin engaging position during operation of said slide pin removal tool.

* * * * *